US005662040A

United States Patent [19]

Mori et al.

[11] Patent Number: 5,662,040

[45] Date of Patent: Sep. 2, 1997

[54] STRUCTURES OF A DRUM AND A STENCIL FOR A STENCIL PRINTER

[75] Inventors: Tomiya Mori, Kakuda; Kazuyoshi Kobayashi, Murata-machi, both of Japan

[73] Assignee: Tohoku Ricoh Co., Ltd., Miyagi-ken, Japan

[21] Appl. No.: 490,451

[22] Filed: Jun. 14, 1995

[30] Foreign Application Priority Data

Nov. 21, 1994 [JP] Japan ..... 6-286870
Apr. 21, 1995 [JP] Japan ..... 7-096952

[51] Int. Cl.[6] ..... B41C 1/14

[52] U.S. Cl. ..... 101/128.21; 101/128.4; 101/116; 118/504

[58] Field of Search ..... 101/116, 120, 101/128.21, 128.4; 118/213, 406, 504

[56] References Cited

U.S. PATENT DOCUMENTS

| | | | |
|---|---|---|---|
| 3,877,364 | 4/1975 | Jacquelin | 100/37 |
| 4,537,658 | 8/1985 | Albert | 162/348 |
| 4,541,895 | 9/1985 | Albert | 162/348 |
| 4,911,069 | 3/1990 | Hayama et al. | 101/120 |
| 5,245,932 | 9/1993 | Ujiie | 101/128.21 |
| 5,588,359 | 12/1996 | Hofmann et al. | 101/128.21 |

FOREIGN PATENT DOCUMENTS

| | | |
|---|---|---|
| 0 127 192 | 12/1984 | European Pat. Off. . |
| 34 44 082 | 8/1966 | Germany . |
| 59-229 | 1/1984 | Japan . |
| 59-218889 | 12/1984 | Japan . |
| 63-59393 | 11/1988 | Japan . |
| 1-204781 | 8/1989 | Japan . |
| 5-41026 | 10/1993 | Japan . |
| 995620 | 6/1965 | United Kingdom . |
| 2 254 288 | 10/1992 | United Kingdom . |

*Primary Examiner*—Christopher A. Bennett
*Attorney, Agent, or Firm*—Oblon, Spivak, McClelland, Maier & Neustadt, P.C.

[57] ABSTRACT

In a stencil printer, a drum has the outer periphery thereof formed by a porous sheet having passages for ink therein. The passages are each configured such that the ink entered an inlet pore is diverted from a single perpendicular to the drum at least once, and then flows out via at least one of outlet pores. The pores of the sheet are sized smaller than perforations to be formed in a stencil.

24 Claims, 11 Drawing Sheets

STRUCTURES OF A DRUM AND A STENCIL FOR A STENCIL PRINTER

BACKGROUND OF THE INVENTION

The present invention relates to a stencil printer for printing an image on a paper by supplying ink from the inner periphery of a drum to the paper via a stencil or master wrapped around the drum and perforated in accordance with image data. More particularly, the present invention relates to an improvement in the structure of the drum and the structure of the stencil.

A stencil printer includes a thermal head having heating elements. The heating elements selectively generate heat to perforate a thermosensitive stencil in accordance with image data and thereby form an image in the stencil. The perforated stencil, or master, is wrapped around a drum made up of a porous support and a mesh screen of resin or metal. Ink is supplied from the inner periphery of the drum by a supply member while a paper is continuously pressed against the master by a press roller or similar pressing member. As a result, the ink oozes out via the pores of the drum and the perforations of the master, thereby printing an image on the paper.

The drum for the above application is disclosed in, for example, Japanese Utility Model Publication No. 59-229 and Japanese Patent Publication No. 63-59393. The drum taught in Publication No. 63-59393 has a porous support and a plurality of mesh screens wrapped around the support. The outermost mesh screen is implemented by members of about 250 mesh (pitch of about 100 μm) and having a diameter of about 40 μm. Pores for passing ink therethrough are sized 60 μm to 70 μm square each.

The heating elements have customarily been sized about 40 μm square each and provided with a resolution of 400 dots per inch (dpi). The heating elements are forms a perforation of substantially the same size as itself in the stencil.

The conventional stencil has a laminate structure comprising a film of polyester of similar thermosensitive resin and as thin as about 1 μm to 2 μm, and a porous flexible support implemented as a layer of synthetic fibers or Japanese paper or a mixture layer of Japanese paper fibers and synthetic fibers. The kind of stencil has the following problems. In portions where the Japanese paper fibers are entangled together, ink is obstructed and prevented from being transferred to a paper. As a result, fiber marks appear in the resulting image. For example, a fiber pattern appears in a solid image portion having a substantial area, or thin lines become blurred. Another problem is that when the used master is discarded, the ink deposited thereon is also discarded. This is wasteful from the resource standpoint.

It is a common practice with the stencil printer to use sparingly volatile oil ink or emulsion ink in which oil wraps water. With this kind of ink, when the printer is operated after a long time of interruption, there can be obviated an occurrence that a number of papers are simply wasted due to the evaporation of ink from the support of the drum and mesh screen or the absorption of ink by the porous support of the stencil.

However, the problem with the ink of the kind described is that along period of time is necessary for it to infiltrate into the paper and fully dry. In a continuous print mode, when a paper or printing is laid on the previous printing whose ink is still wet, the ink is transferred from latter to the rear of the former. This is particularly true with a solid image portion to which a great amount of ink is deposited.

In light of the above, it has been proposed to reduce the thickness of the support of the stencil or omit it in order to reduce the fiber marks and the amount of ink to be discarded. However, the outermost mesh screen of the drum has openings of substantially the same size as perforations to be formed in the stencil. Hence, even the above proposed scheme scarcely obviates the transfer of the ink from the underlying printing to the rear of the overlying printing. Further, when the support of the stencil is omitted, the stencil or master contacts the protruding portions of the mesh screen. As a result, when the paper is pressed against the master during printing, the stencil suffers from wear and, therefore, holes due to friction. This causes the ink to smear the paper.

To eliminate the undesirable ink transfer, previously mentioned Publication No. 63-59393 teaches a drum having a hollow cylindrical support having a number of pores, an inner screen layer surrounding the support, and an outer screen layer surrounding the inner layer. The mesh value is sequentially increased from the support to the outer screen layer in order to reduce the size of ink passages, i.e., to reduce the amount of ink to be drawn out from the drum. This kind of structure is also disclosed in Japanese Utility Model Publication No. 5-41026 in which the mesh value is sequentially decreased from the inner screen layer to the outer screen layer. However, because the openings of the outer mesh screen have substantially the same size as the perforations of the stencil, the ink does not break off sharply and is transferred to a paper in a great amount. This also results in the transfer of the ink from the underlying printing to the rear of the overlying printing.

SUMMARY OF THE INVENTION

It is, therefore, an object of the present invention to provide a drum and a stencil for a stencil printer and capable of obviating the ink transfer to the rear of the overlying printing.

It is another object of the present invention to provide a drum and a stencil for a stencil printer and capable of ensuring clear-cut images free from fiber marks.

It is a further object of the present invention to provide a drum and a stencil for a stencil printer and capable of eliminating the waste of ink.

In accordance with the present invention, a porous sheet forming an outer periphery of a drum of a stencil printer, and for supplying ink from the inner periphery of the drum to a paper via the porous sheet and a perforated stencil wrapped around the drum has a support layer constituting a body, inlet pores formed in the support layer and for receiving the ink from the inner periphery of the drum, outlet pores formed in said support layer and for discharging the ink, and passages formed in the support layer and each for causing the ink entered any one of the inlet pores to be diverted from a single perpendicular to the drum at least once, and then flow out via associated one of the outlet pores.

Also, in accordance with the present invention, a stencil for supplying ink fed from an inner periphery of a drum of a stencil printer to a paper via perforations of the stencil by being wrapped around the drum has a porous substrate formed with inlet pores and outlet pores for passing the ink therethrough, a thermosensitive resin film to be perforated, and passages formed in the porous substrate and each for causing the ink entered any one of the inlet pores to be diverted from a single perpendicular to the drum at least once, and then flow out via associated one of the outlet pores.

Further, in accordance with the present invention, a stencil printer for printing an image on a paper by supplying ink to the paper via a stencil formed with perforations has a master making unit for perforating the stencil by heat for thereby producing a master, a drum having the outer periphery thereof formed by a porous sheet and for wrapping the master therearound, an ink supply unit for supplying the ink from the inner periphery of the drum to the master, and a pressing member for pressing the paper against the master. The porous sheet has a support layer constituting a body, inlet pores formed in the support layer and for receiving the ink entered any one of the inlet pores to be diverted from a single perpendicular to the drum at least once, and then flow out via associated one of the outlet pores.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
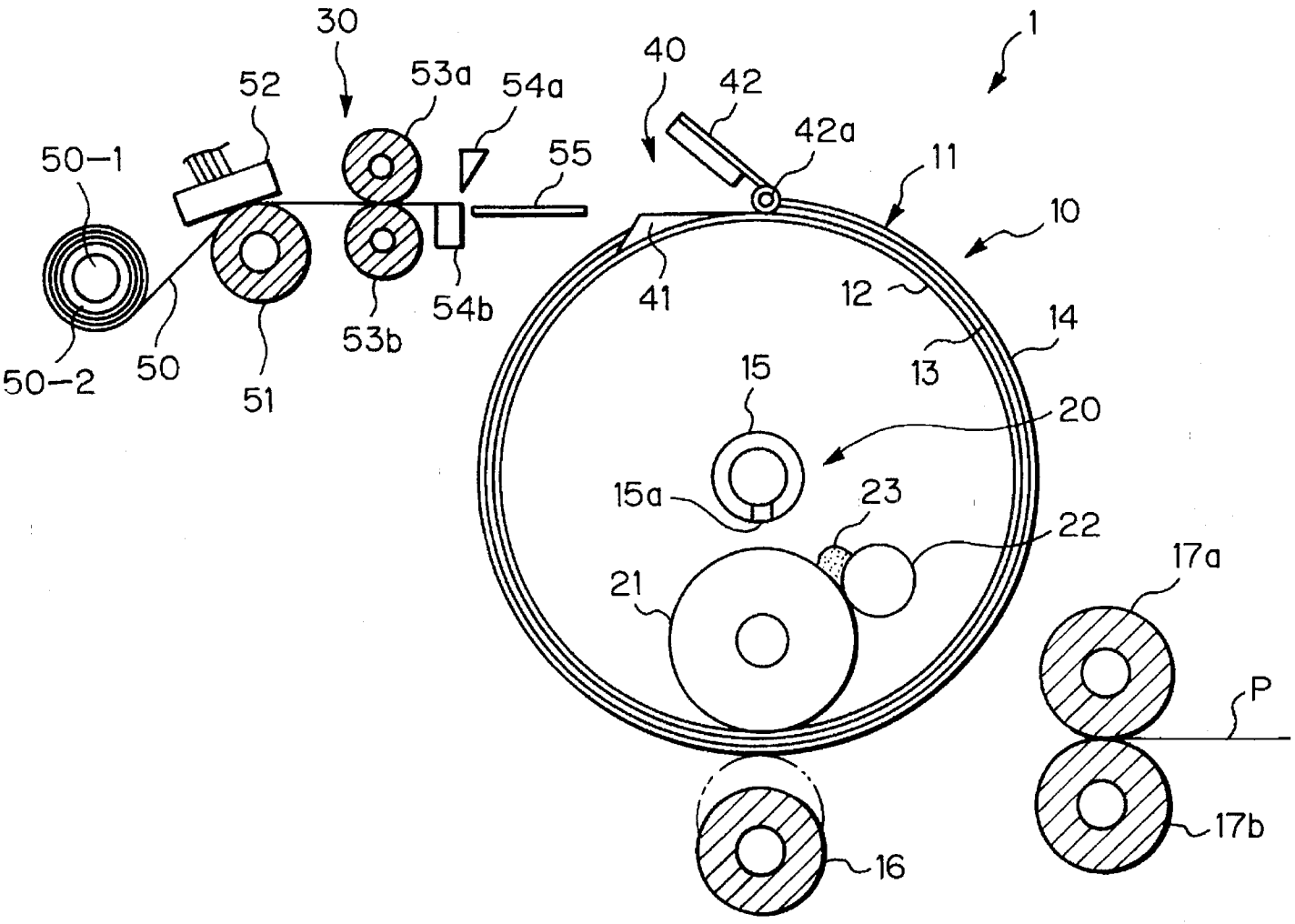
FIG. 1 is a section of a stencil printer to which the present invention is applied.

Referring to FIG. 1 of the drawings, a stencil printer to which the present invention is applicable is shown and generally designated by the reference numeral 1. As shown, the printer 1 is generally made up of a printing unit 10, an ink supply unit 20, a master making unit 30, and a paper feed unit, not shown.

The printing unit 10 has a drum 11 made up of three layers, i.e., a cylindrical porous support layer 12, an ink retaining layer 13 surrounding the layer 12, and a porous sheet 14 surrounding the layer 13 and forming the outer periphery of the drum 11. The layer 13 constitutes a mesh screen. The drum 11 is mounted on a hollow center shaft 15 which plays the role of an ink pipe at the same time, as will be described later specifically. The drum 11 is rotated around the shaft 15 by a motor, not shown.

The ink supply unit 20 is disposed in the drum 11 and has an ink roller 21 for supplying ink to the inner periphery of the support layer 12. A doctor roller 22 is positioned parallel to the ink roller 21 and spaced apart from the roller 21 by a small gap. The rollers 21 and 22 cooperate to form an ink well 23 therebetween. Ink is fed to the ink well 23 by the shaft 15. The rollers 21 and 22 are rotatably supported by axially opposite end walls, not shown, provided on the shaft 15 within the drum 11. The ink is fed to the shaft 15 under pressure by a pump, not shown, from an ink pack located at a suitable position of the printing unit 10. The ink is supplied from the shaft 15 to the well 23 via a hole 15*a* formed in the shaft 15. A paper P is fed from the paper feed unit toward the drum 11. A press roller 16 and a pair of registration rollers 17*a* and 17*b* are located in the vicinity of the lower part of the outer periphery of the drum 11. The press roller 16 presses the paper P against the drum 11. The registration rollers 17*a* and 17*b* cooperate to drive the paper P to between the drum 11 and the press roller 16 at a predetermined timing.

A clamping device 40 is mounted on the outer periphery of the drum 11. The device 40 is made up of a stage 41 and a clamper 42. The stage 41 is made of a magnetic material and extends in the axial direction of the drum 11. The clamper 42 is positioned to face the stage 41 and pivotably supported by a shaft 42*a*. A magnet is adhered to the surface of the clamper 42 that faces the stage 41. The stage 41 may be made of a material such as a metal attracted by the magnet. The clamper 42 is opened and closed at a predetermined position by opening and closing means, not shown.

The master making unit 30 has stencil support means 50-1 supporting a stencil 50 rolled round a core 50-2. A rotatable platen roller 51 conveys the stencil 50 paid out from the roll. A thermal head, or perforating means, 52 is movable into and out of contact with the platen roller 51. A pair of rollers 53*a* and 53*b* are located downstream of the platen roller 51 in order to convey the stencil 50 perforated by the head 52. A pair of cutter members 54*a* and 54*b* are positioned downstream of the roller pair 53*a* and 53*b* and cuts the stencil 50 at a predetermined length. A guide 55 guides the cut stencil, or master, 50 toward the clamping device 40.

The rotatable platen roller 51 is mounted on a shaft rotatably supported by end walls of the printer 1 and driven at a predetermined peripheral speed by a stepping motor, not shown. In this condition, the roller 51 conveys the stencil 50 while pressing it against the thermal head 52. The head 52 has an array of heating elements extending in the widthwise direction of the stencil 50 and is moved into and out of contact with the roller 51 by moving means, not shown. The heating elements are provided with a resolution of 400 dpi, and each is sized 40 μm square. Specifically, an analog image signal representative of a document image is converted to a digital image signal by an analog-to-digital converter included in an image reading section, not shown.

The digital signal is processed by a perforation control section, not shown. The head 52 selectively perforates the stencil 50 in accordance with the processed digital signal, thereby forming an image in the stencil 50. The roller 53*b* is rotated by the stepping motor, which drives the platen roller 51, by way of a torque limiter. The roller 53*a* is driven by the roller 53*b* . The peripheral speed of the roller 53*b* is selected to be slightly higher than the peripheral speed of the roller 51. This difference is peripheral in speed causes a predetermined degree of tension to act on the stencil 50 between the roller 51 and the rollers 53*a* and 53*b*, thereby preventing the stencil 50 from creasing.

It is to be noted that the platen roller 51, thermal head 52 and rollers 53*a* and 53*b* each has a width at least equal to the width of the stencil 50.

In operation, a document is set on the image reading section, and then a start button is pressed. In response, the drum 11 starts rotating. At this instant, a used master having been wrapped around the drum 11 is separated from the drum 11 and discarded by a discharging device, not shown. The drum 11 is brought to a stop as soon as the clamping device 40 reaches substantially the uppermost position. Then, the opening and closing means causes the clamper 42 to rotate about the shaft 42*a* away from the stage 41, i.e., to open. In this position, the clamper 42 waits for a master. Subsequently, the stepping motor is driven to rotate the platen roller 51. The roller 51 pays out the stencil 50 from the core 50-2 and conveys it. At the same time, the heating elements of the heat 52 selectively generate heat in response to the digital image signal fed from the perforation control section. As a result, the head 52 starts perforating the stencil 50 in accordance with the image signal.

The leading edge of the stencil 50 is sequentially conveyed toward the clamping device 40 by the rollers 51, 53*a* and 53*b* over the guide 55. When the number of steps of the stepping motor reaches a preselected value, it is determined that the leading edge of the stencil 50 has entered the clearance between the clamper 42 and the stage 41. Then, the shaft 42*a* is rotated by the opening and closing means to close the clamper 42. As a result, the leading edge of the stencil 50 is clamped by the stage 41 and clamper 42. At the same time, the drum 11 is rotated clockwise, as viewed in the figure, at the same peripheral speed as the platen roller 51, wrapping the stencil 50 around it.

When the stencil 50 is wrapped around the drum 11 over a predetermined length, the rotation of the drum 11 and rollers 51, 53*a* and 53*b* is once stopped. At the same time, the cutter members 54*a* and 54*b* cut the stencil 50. Then, the drum 11 is again rotated clockwise to pull out the trailing edge, not shown, of the stencil or master 50 from the master making unit 30. Consequently, the master 50 is fully wrapped around the drum 11.

The drum 11 carrying the master 50 therewith is rotated clockwise while a single paper P is fed from the paper feed unit to between the registration rollers 17*a* and 17*b*. The rollers 17*a* and 17*b* once stop the movement of the paper P and again drive it in synchronism with the rotation of the drum 11. Hence, the paper P is inserted between the master 50 on the drum 11 and the press roller 16 at an adequate timing. At this instant, the ink roller 21 is rotated in the same direction as the drum 11. The ink in the ink well 23 is deposited on the surface of the ink roller 21 being rotated. The doctor roller 22 regulates the amount of the ink being conveyed by the ink roller 21. The regulated amount of ink is supplied to the inner periphery of the support layer 12. As the ink roller 21 is further rotated, the ink penetrates the porous support layer 12, ink retaining layer 13 and porous sheet 14 to reach the master 50. The sheet 14 has inlet pores and outlet pores as will be described later.

Subsequently, the press roller 15 is raised to press the paper P against the master 50 wrapped around the porous sheet 14 of the drum 11 being rotated. As a result, the ink is transferred to the paper P via the perforations of the master 50 which will also be described later specifically. The ink forms an image representative of the document image on the paper P. The paper P with the image, i.e., a trial printing is separated from the master 50 by a separator, not shown, and then driven out to a tray, not shown. After the trial printing, the press roller 16 is moved away from the drum 11 to its original position. In this condition, the entire printer 1 waits for a print start command. Thereafter, the above procedure is repeated to produce a desired number of printings.

Figure 2:
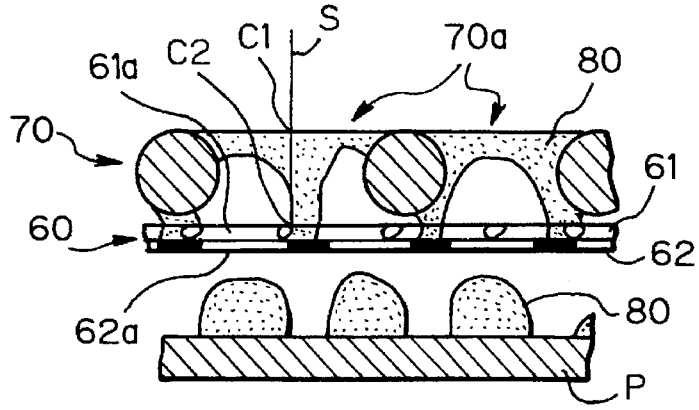
Fig. 2 PRIOR ART
FIG. 2 demonstrates the transfer of ink in a conventional stencil printer.

A reference will be made to FIG. 2 for describing the transfer of the ink from the front of one printing to the rear of the next printing. The transfer is attributable to the structure of a drum and that of a master included in a conventional stencil printer. It has been customary with a stencil printer to press a paper against a master wrapped around a drum by a press roller and thereby cause ink to ooze out from the inside of the drum, as stated above. After the transfer of the ink to a paper via the master, the paper is separated from the master and then driven out to a tray. Specifically, as shown in FIG. 2, when a paper P is separated from a master 60, ink 80 is drawn out in a great amount via the pores of a support layer, not shown, the pores 70*a* of a mesh screen 70, the pores 61*a* formed in a porous substrate 61 forming part of the master 60, and pores 62*a* formed in a thermoplastic resin film 62 forming the other part of the master 60. At this instant, each pore 70*a* of the mesh screen 70 has centers C1 and C2 at the inlet side and outlet side, respectively, which are positioned on a single perpendicular S connecting the center and surface of the drum. As a result, the ink 80 is transferred to the paper P in a great amount, slipping on the inner walls of the pores 70*a*. Hence, a substantial period of time is necessary for the ink 80 to dry, resulting in the undesirable transfer of the ink to the rear of the next printing.

An embodiment of the present invention free from the above problem will be described hereinafter. As shown in FIG. 1, in the illustrative embodiment, the drum 11 is made up of the support layer 12, ink retaining layer 13, and porous sheet 14. The support layer 12 is made of stainless steel of similar substantially rigid material and provided with a hollow cylindrical configuration. The clamping device 40 is mounted on the outer periphery of the support layer 12. The support layer 12 is formed with a number of pores for passing the ink therethrough, except for the area around the clamping device 40 and the opposite side edge portions. The ink retaining layer 13 is implemented as a metallic mesh screen or made of foam resin in order to retain and pass the ink therethrough. If desired, a plurality of ink retaining layers may be provided. Further, the layer 13 is not essential and may be omitted.

Figure 3A:
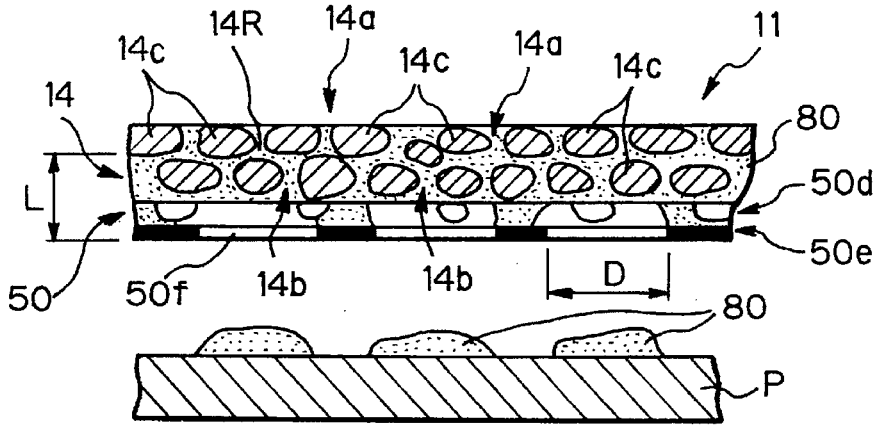
FIG. 3A is a fragmentary section of a porous sheet of a drum and a stencil for use with the printer shown in FIG. 1.
Figure 3B:
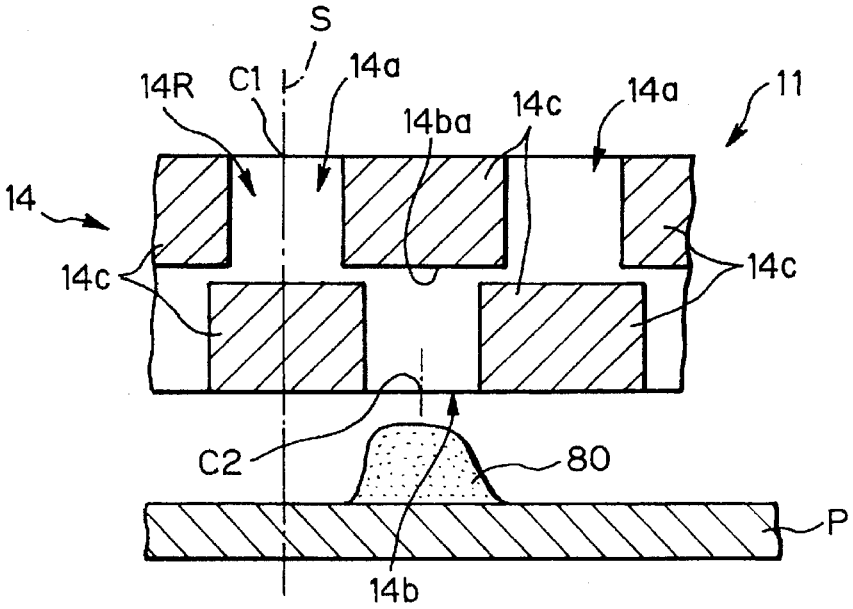
FIG. 3B is an enlarged model section showing part of the sheet and stencil of FIG. 3A.

As shown in FIGS. 3A and 3B, the porous sheet 14 has pores 14*a* open to the ink inlet side and pores 14*b* open to the ink outlet side. The pores 14*a* and 14*b* respectively have centers C1 and C2 which are not positioned on a single perpendicular S to the drum 11. Hence, the pores 14*a* and 14*b* form passages 14R each being configured such that the ink 80 entered the inlet pore 14*a* flows out via the outlet pore 14*b* after being diverted from the perpendicular S at least once. When the paper P is separated from the master 50, adhesion acts between the upper walls 14*ba* of the outlet pores 14*b* and the ink 80 due to the viscosity of the ink 80. As a result, the amount of the ink 80 to be drawn out from the sheet 14 is reduced.

As shown in FIGS. 3A and 3B, the porous sheet 14 is implemented by fibrous members 14*c* constituting a main body of the sheet 14. Alternatively, the sheet 14 may be implemented as an unwoven cloth of resin or metal, a sintered material, or sponge or similar foam resin. In the embodiment, the heating elements of the thermal head 52 has a resolution of 400 dpi and each is sized 40 μm square, as stated earlier. Hence, the fibrous members 14*c* are each provided with a diameter of 20 μm to 30 μm.

Each passage 14R having the above configuration refers to a passage which causes the fibrous member 14*c*, located on the perpendicular S, to obstruct substantially the entire ink 80 entered the inlet pore 14*a*, thereby preventing it from flowing down along the perpendicular S. Stated another way, the passage 14R is a path which once steers substantially the entire ink entered the inlet pore 14*a* to the outside of the pore 14*a* with the member 14*c* and then causes it to flow down into the outlet pore 14*b*. This is also true with alternative embodiments to be described.

FIG. 3A also shows a master or stencil 50 having a porous substrate 50*d* and a thermoplastic resin film 50*e*. Perforations 50*f* are formed in the master 50 by the master making unit 30. The support layer 12 and ink retaining layer 13 are not shown in FIG. 3A. FIG. 3B is a fragmentary enlarged view corresponding to FIG. 3A; and master 50 is not shown.

Figure 4A:
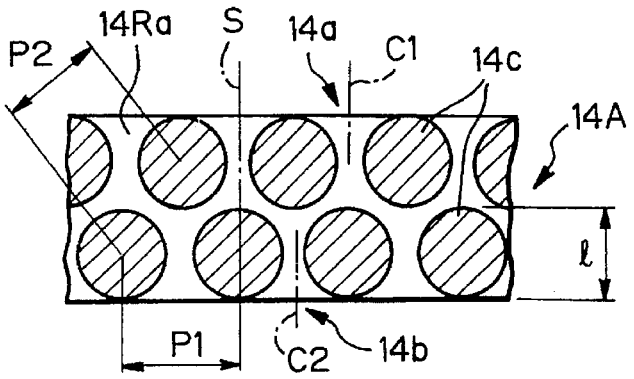
FIGS. 4A–4E are fragmentary sections each showing another specific configuration of the porous sheet.

FIGS. 4A–4E each shows another specific configuration of the porous sheet 14. FIG. 4A shows a porous sheet 14A having two arrays of fibrous members 14*c* in a zig-zag configuration. An inlet pore 14*a* and an outlet pore 14*b* respectively have centers C1 and C2 which are deviated from each other in the circumferential direction of the drum 11. The pores 14*a* and 14*b*, therefore, define a passage 14R*a* which is diverted from a single perpendicular S to the drum 11 once.

Figure 4B:
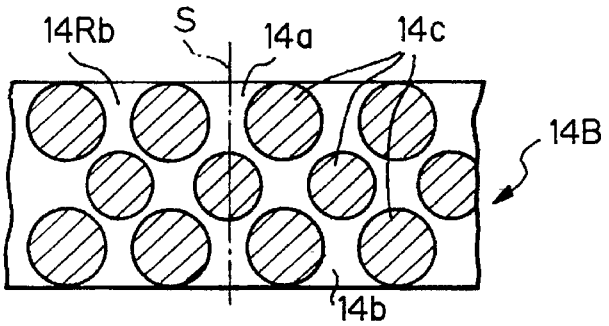

FIG. 4B shows a porous sheet 14B having three arrays of fibrous members 14*c* also staggered from each other. Hence, a passage 14R*b* is formed which is diverted from the perpendicular S a plurality of times.

Figure 4C:
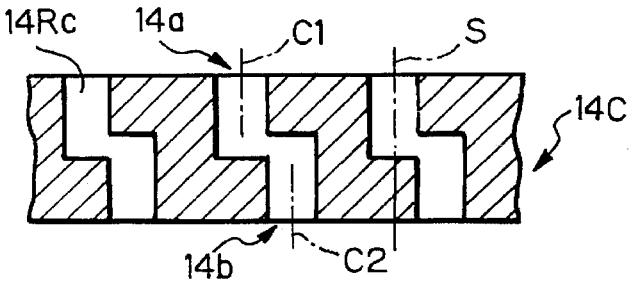

FIG. 4C shows a porous sheet 14C in which the centers C1 and C2 of the inlet and outlet pores 14*a* and 14*b* are also deviated in the circumferential direction of the drum 11. The pores 14*a* and 14*b* define a crank-like passage 14R*c* diverted from the perpendicular S once.

Figure 4D:
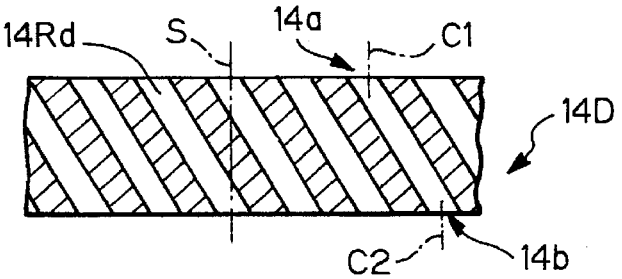

FIG. 4D shows a porous sheet 14D in which the centers C1 and C2 of the inlet and outlet pores 14*a* and 15*b* are also deviated in the circumferential direction of the drum 11. The pores 14*a* and 14*b* form a passage 14R*d* which is linearly and obliquely deviated from the perpendicular S.

Figure 4E:
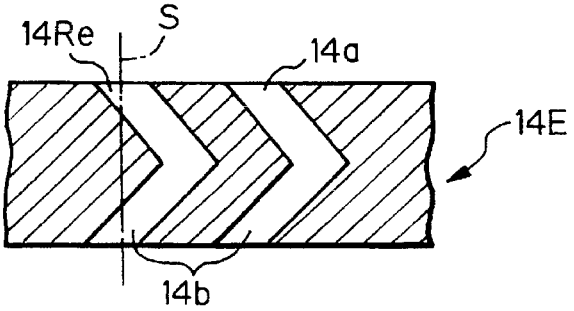

FIG. 4E shows a porous sheet 14E having a generally V-shaped passage 14Re diverted a plurality of times from the perpendicular S.

The sheets 14C–14E shown in FIGS. 4C–4E, respectively, are made of rubber, resin, metal or the like. In FIGS. 4A, 4C and 4D, the centers C1 and C2 may be deviated from each other in a direction other than the circumferential direction of the drum 11, e.g., in the axial direction of the drum 11.

Figure 5:
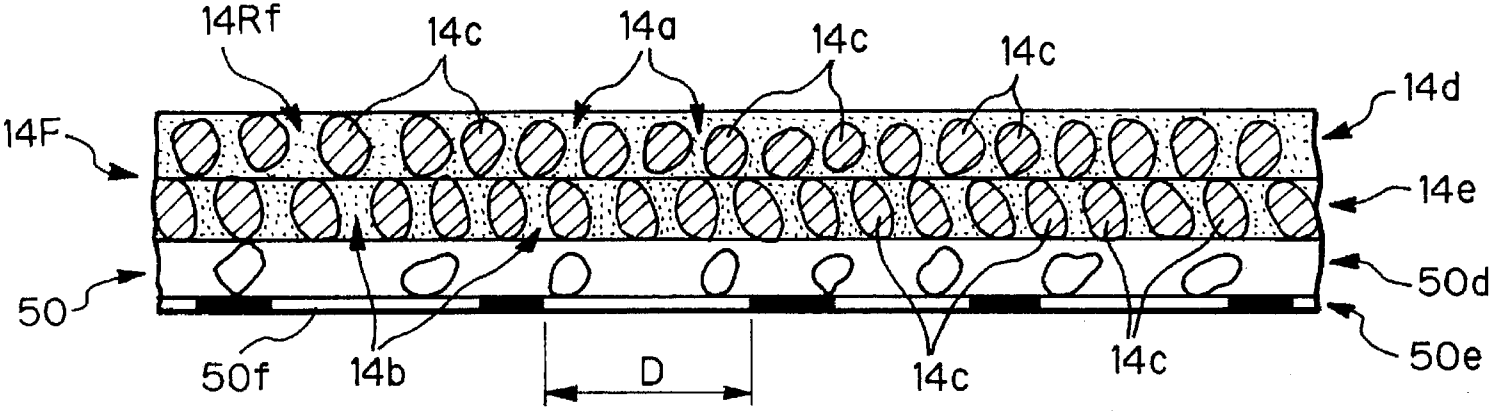
FIG. 5 is a fragmentary section showing still another specific configuration of the porous sheet.

FIG. 5 shows still another porous sheet 14F having two screens 14*d* and 14*e* stacked in the same configuration as in the sheet 14A of FIG. 4A. The screens 14*d* and 14*e* each has the fibrous members 14*c*. While the screens 14*d* and 14*e* may preferably be adhered to each other, they may be adhered only at their edges.

The sheets 14A–14F, like the sheet 14, are capable of reducing the amount of the ink 80 to be drawn out therefrom.

Figure 6:
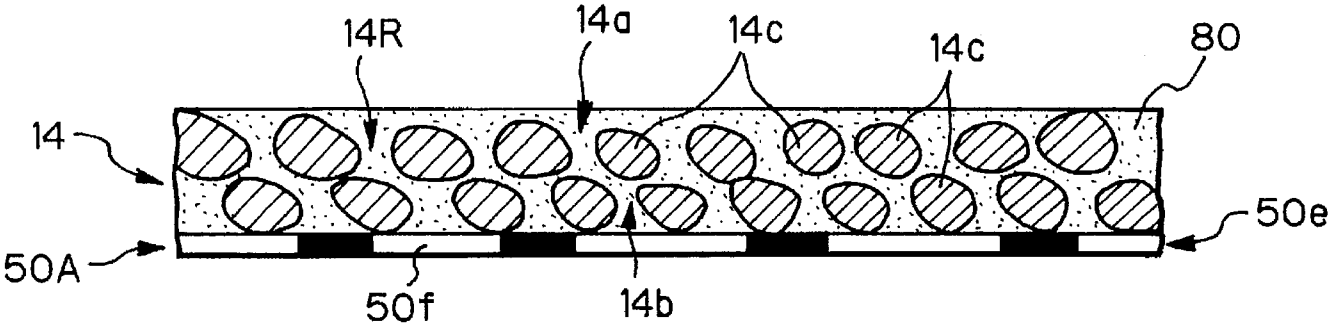
FIG. 6 is a fragmentary section showing a specific configuration of the stencil.

The stencil 50 made up of the porous substrate 50*d* and thermoplastic resin film 50*c* is wrapped around the porous sheet 14F of FIG. 5, as also shown in FIG. 3A. Alternatively, as shown in FIG. 6, use may be made of a stencil 50A simply implemented only by a thermoplastic resin film 50*e*. It is to be noted that a stencil implemented only by a thermoplastic resin film also refers to a stencil implemented by a thermoplastic resin film containing a trace of antistatic agent or similar agent, and a stencil implemented by a thermoplastic resin film carrying at least one overcoat layer or similar thin film on at least one of opposite sides thereof. Of course, even in the stencil made up of the resin film and porous substrate, the film may contain a trace of antistatic agent or similar agent or may carry at least one overcoat layer or similar thin film on the surface thereof.

In FIGS. 4A, 4B and 5, the fibrous members 14*c* have a maximum outside diameter 1 and pitches P1 and P2 (see FIG. 4A) selected to be smaller than the diameter D of each perforation 50*f* formed in the master 50 (see FIG. 5). In this condition, the bore of the porous sheet 14 located above the perforations 50*f* and where the ink 80 may be present is reduced. This further reduces the amount of the ink 80 to be drawn out from the sheet 14A, 14B or 14F.

The porous sheet 14 of FIG. 3A also has the maximum outside diameter 1 and pitches P1 and P2, not shown, of the fibrous members 14*c* selected to be smaller than the diameter D of the perforations 50*f*. As a result, the amount of the ink 80 to be drawn out from the sheet 14 via the perforations 50*f* is reduced.

In the illustrative embodiment, any one of the porous sheets 14 and 14A–14F may be combined with the stencil 50A shown in FIG. 6. The stencil 50A is implemented only by a thermoplastic resin film 50*e*.

Figure 7A:
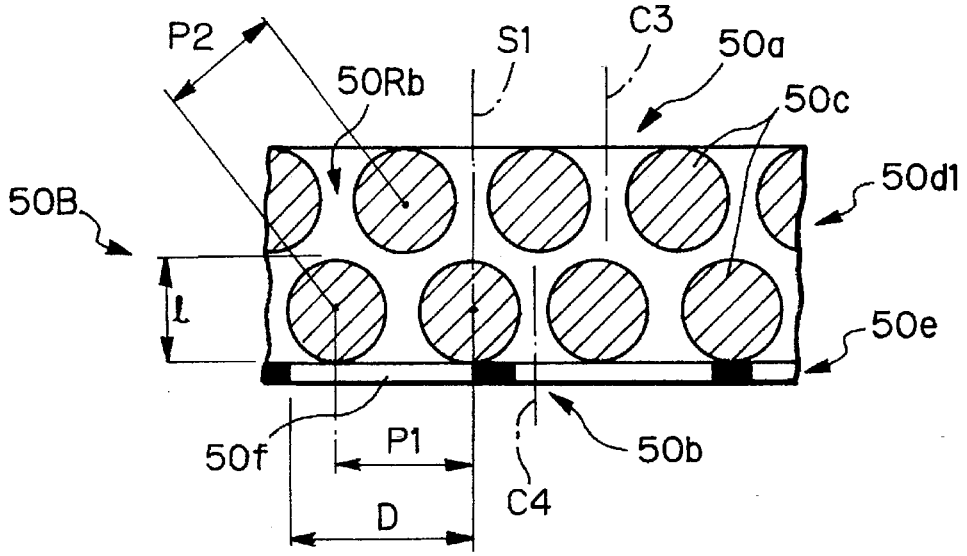
FIGS. 7A–7C are fragmentary sections each showing another specific configuration of the stencil.
Figure 7B:
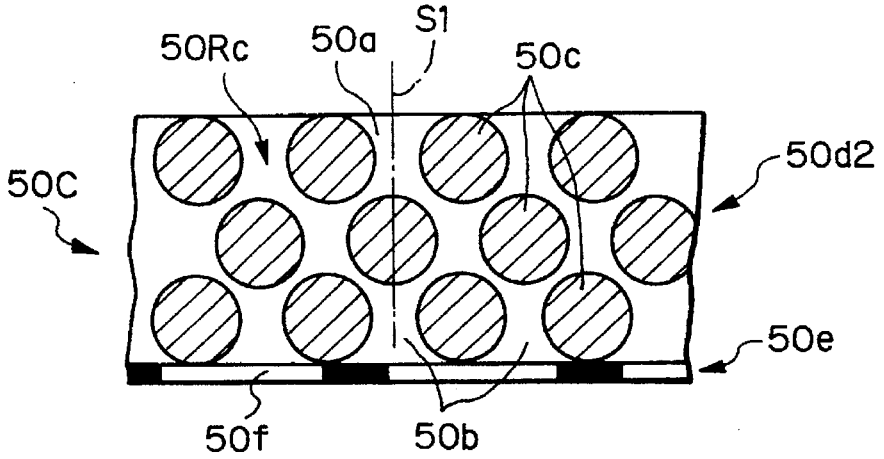
Figure 7C:
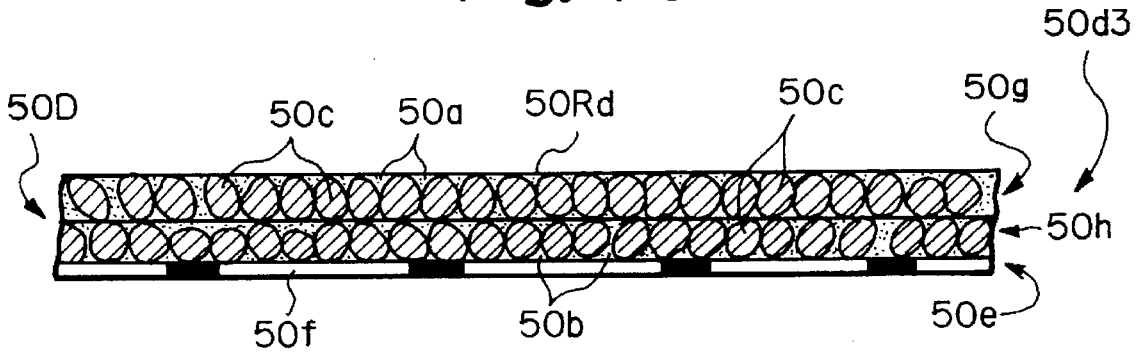

FIGS. 7A–7C each shows another specific configuration of the stencil 50. In FIG. 7A, a stencil 50B has a porous substrate 50*d*1 having two arrays of fibrous members 50*c* staggered from each other. An inlet pore 50*a* and an outlet pore 50*b* respectively have centers C3 and C4 which are deviated from each other. The pores 50*a* and 50*b*, therefore, define a passage 50Rb which is diverted from a single perpendicular S1 to the substrate 50*d*1 once.

FIG. 7B shows a stencil 50C having a porous substrate 50*d*2 having three arrays of fibrous members 50*c* also staggered from each other. Hence, a passage 50Rc is formed which is diverted from the perpendicular S1 a plurality of times.

FIG. 7C shows a stencil 50D having a porous substrate 50*d*3 having two screens 50*g* and 50*h* stacked in the same configuration as in the stencil 50B of FIG. 7A, thereby forming a passage 50Rd. The screens 50*g* and 50*h* each has the fibrous members 50*c*. While the screens 50*g* and 50*h* may preferably be adhered to each other, they may be adhered only at their edges.

In any of the stencils 50B, 50C and 50D, the passage 50Rb, 50Rc or 50Rd is configures such that the ink 80 entered each inlet pore 50*a* is derived from the single perpendicular S1 at least once and then flows out via the outlet pores 50*b*.

In FIGS. 7A–7C, the fibrous members 50*c* of the porous substrates 50*d*1–50*d*3 have a maximum outside diameter 1 and pitches P1 and P2 (see FIG. 7A) selected to be smaller than the diameter D of each perforation 50*f* formed in the resin film 50*e*. In this condition, the bores of the substrates 50*d*1–50*d*3 located above the perforations 50*f* are reduced.

This further reduces the amount of the ink 80 to be drawn out from the substrates **50*d*1–50*d*3 via the perforations 50*f***.

The stencils 50B–50D may each be wrapped not only around the drum having any one of the porous sheets 14 and 14A–14F, but also around a conventional drum lacking it. In this case, the ink 80 is not easily drawn out from the porous substrates **50*d*1–50*d*3 and, therefore, transferred to the paper P in a small amount. The substrates 50*d*1–50*d*3** may each be implemented as an unwoven cloth of resin or metal, a sintered material, or sponge or similar foam resin.

Figure 8A:
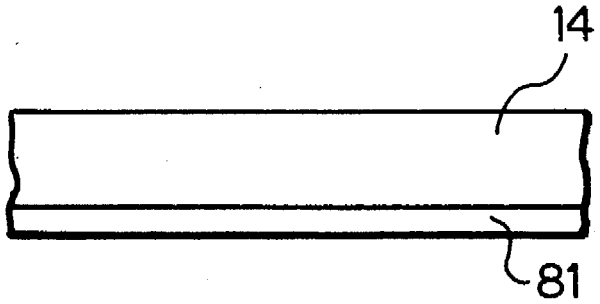
FIGS. 8A and 8B each shows a specific arrangement for evaluating passages formed in the porous sheet.

Referring to FIG. 8A, a specific method of determining whether or not the passages formed in the porous sheet have a desired configuration will be described. As shown, a paper 81 different in color from, for example, the sheet 14 of FIG. 3A is adhered to one side of the sheet 14. Then, the other side of the sheet 14 is illuminated and observed via a microscope in 50 magnifications. If the paper 81 is not visible through the gaps between the fibrous members **14*c*, it is determined that the expected passages 14R are formed in the sheet 14**.

Figure 8B:
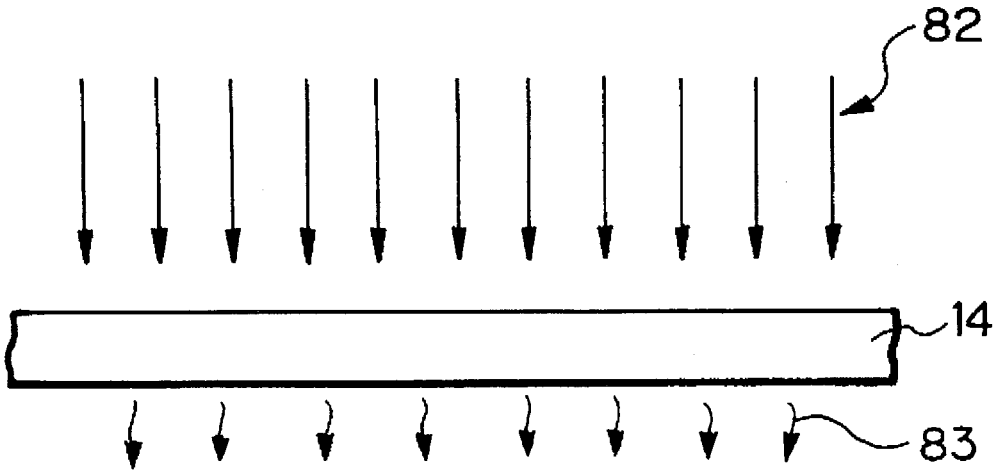

FIG. 8B shows another specific method which illuminates one side of the porous sheet 14 with parallel rays 82 perpendicular to the sheet 14. The quantity of light reaching the other side of the sheet 14 is measured by a sensor, e.g., laser type sensor LX2-100 (trade name) available from Keyence. Because the parallel rays 82 are reflected in the passages 14R, they do not reach the other side of the sheet 14. Hence, if rays 83 are not sensed by the sensor, it is determined that the passages 14R of desired configuration are formed in the sheet 14. Of course, the decision using the method of FIG. 8A or 8B is also applicable to the other specific porous sheets 14A–14F.

Further, the method of FIG. 8A or 8B may be used to determine whether or not the porous substrates **50*d*1–50*d*3 of the stencils 50B–50D, FIGS. 7A–7C, are formed with the expected passages 50Rb–50Rd, respectively. The passages 50Rb–50Rd are each expected to divert the ink 80 entered the inlet pore 50*a* from the single perpendicular S1 at least one and then cause it to flow out via the outlet pore 50*b***.

Figure 9:
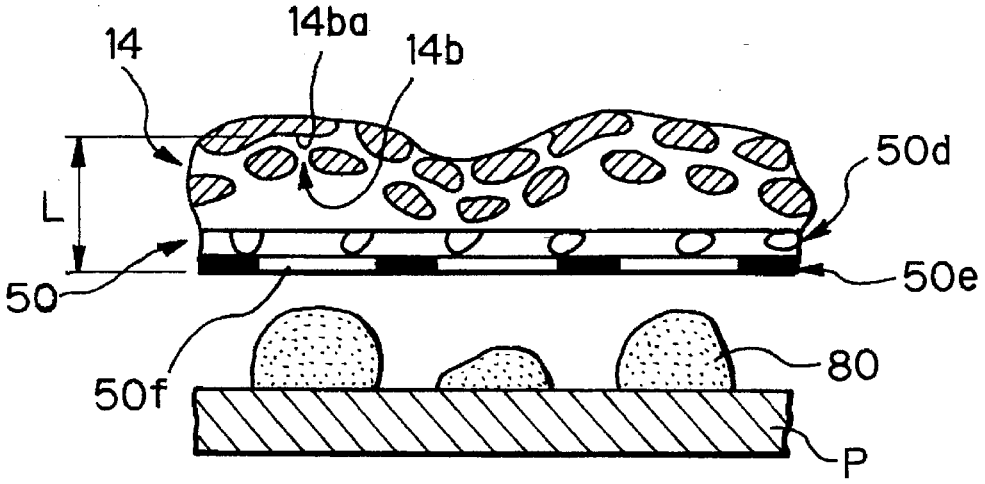
FIG. 9 demonstrates the transfer of ink to occur when use is made of an undulated porous sheet.

As shown in FIG. 9, the amount of the ink 80 to be drawn out from the porous sheet 14 is related to the distance L between the surface of the stencil 50 and the ceiling portion **14*ba* of the outlet pore 14*b*. That is, the amount of the ink 80 to be drawn out increases with an increase in distance L. In light of this, as shown in FIG. 3A, the surface of the sheet 14 to contact the master 50 is smoothed in order to reduce the distance L, i.e., the amount of the ink 80 to be drawn out from the sheet 14. Further, the distance L is also related to the thickness of the porous substrate 50*d* of the stencil 50. It follows that the thickness of the substrate 50*d*** should preferably be less than about 50 μm.

Figure 10:
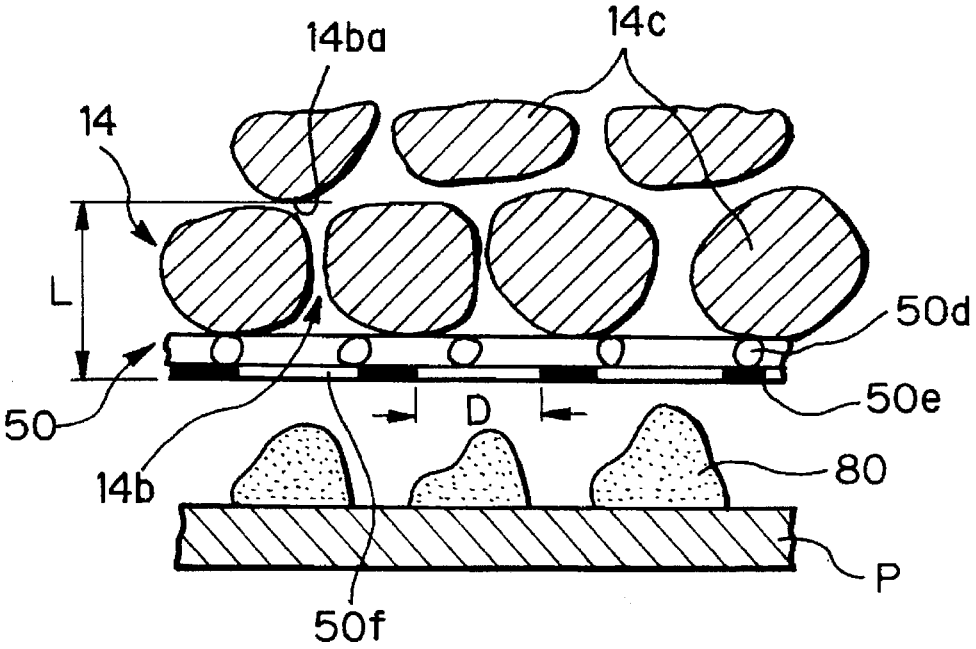
FIG. 10 shows the transfer of ink to occur when use is made of a porous sheet implemented by fibers greater in diameter than the perforations of a stencil.

Further, as shown in FIG. 10, the distance L increases if the outside diameter of each fibrous member **14*c* of the sheet 14, as measured in the direction parallel to the single perpendicular S to the drum 11, is greater than the diameter D of the perforations 50*f*. In light of this, as shown in FIG. 3A, the outside diameter of the members 14*c*, as measured in the above direction, is selected to be smaller than the diameter D of the perforations 50*f* in order to reduce the amount of the ink 80 to be drawn out from the sheet 14**.

Likewise, in the stencils 50B–50D shown in FIGS. 7A–7C, the fibrous members **50*c* of the porous substrates 50*d*1–50*d*3 are each provided with an outside diameter, as measured in the direction parallel to the single perpendicular S1, smaller than the diameter D of the perforations 50*f*. This further reduces the amount of the ink to be drawn out from the substrates 50*d*1–50*d*3**.

Figure 11:
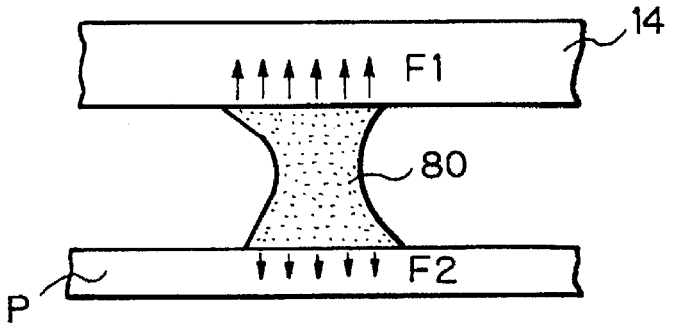
FIG. 11 is a view representative of a relation between adhesion acting between a paper and ink and adhesion acting between the porous sheet and the ink.

Furthermore, as shown in FIG. 11, the amount of the ink 80 to be drawn out from the sheet 14 when the paper P is separated from the master 50 is related to the adhesion or adhesive force F1 acting between the ink 80 and the sheet 14, and an adhesive force F2 acting between the ink 80 and the paper P. The force F1 tends to draw the ink 80 into the sheet 14 while the force F2 tends to draw it out of the sheet 14. To reduce the amount of the ink 80, it is necessary that the force F1 should be greater than the force F2.

Figure 12A:
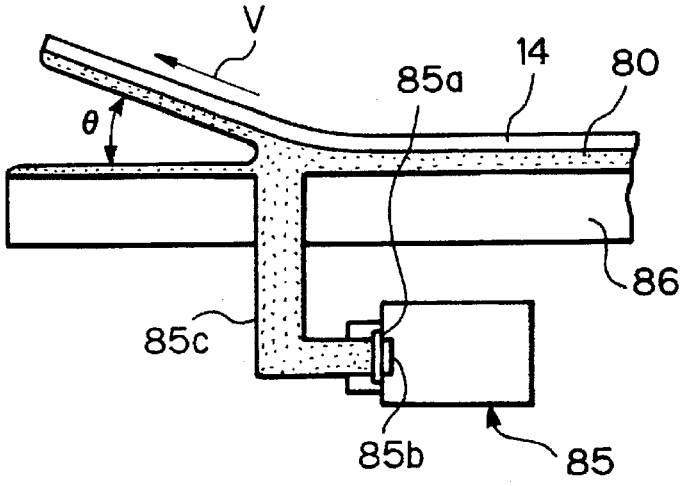
FIGS. 12A and 12B each shows a specific method of measuring the adhesion between the porous sheet and the ink.

FIG. 12A shows a specific arrangement for measuring the force F1. There is shown in the figure a pressure sensor 85 having a diaphragm **85*a* and a strain gauge 85*b* affixed thereto, e.g., a pressure sensor PD104 (trade name) available from Toyota Koki. The pressure sensor 85 is mounted on a metallic plate 86. The ink 80 is applied to the plate 86 in a predetermined thickness (e.g. 0.3 mm), and then the sheet 14 is laid on the ink 80. Subsequently, the sheet 14 is partly torn off from the ink 80 to a predetermined angle θ (e.g. 30°) at a predetermined rate V (e.g. 30 mm/sec). The resulting output of the pressure sensor 85 is representative of the force F1. The reference numeral 85*c* in FIG. 12A** designates a pipe.

Figure 12B:
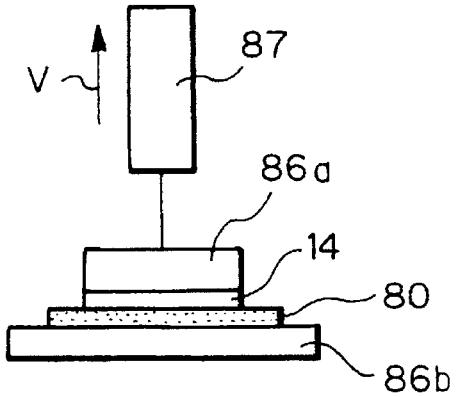

FIG. 12B shows another specific arrangement for measuring the force F1. As shown, the sheet 14 is adhered to a ϕ30 plate **86*a*, and then the ink 80 is applied to a plate 86*b* in a predetermined thickness (for example, 0.3 mm). The sheet 14 adhered to the plate 86*a* is laid on the ink 80. In this condition, the plate 86*a* is pulled by a tension gauge 87 in the direction perpendicular to the plate 86*b* and at a predetermined rate V (30 mm/sec). The resulting maximum value of the gauge 87 is representative of the force F1**.

The other adhesive force F2 can also be measured by the method of FIG. 12A or FIG. 12B only if the paper P is substituted for the sheet 14.

To make the force F1 greater than the force F2, the fibrous members **14*c* of the sheet 14 are provided with a diameter smaller than the diameter D of the perforations 50*f* of the stencil 50 or relative to the texture of the paper P. In addition, the pitches P1 and P2 of the members 14*c* are reduced to allow the sheet 14 and ink 80** to contact over a broad area.

Figure 13A:
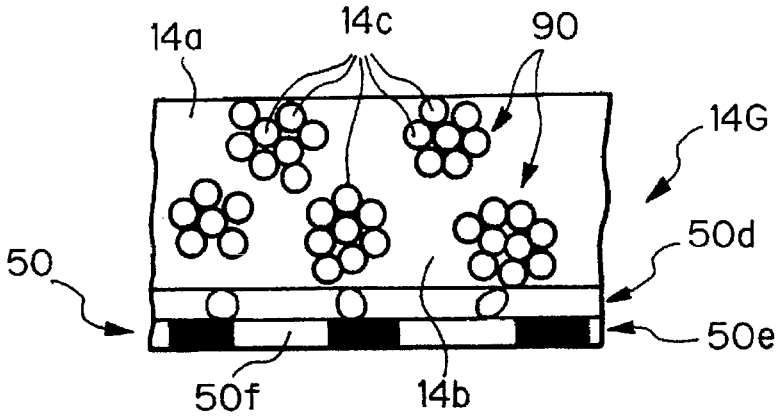
FIGS. 13A–13C are fragmentary sections each showing another specific configuration of the porous sheet.
Figure 13B:
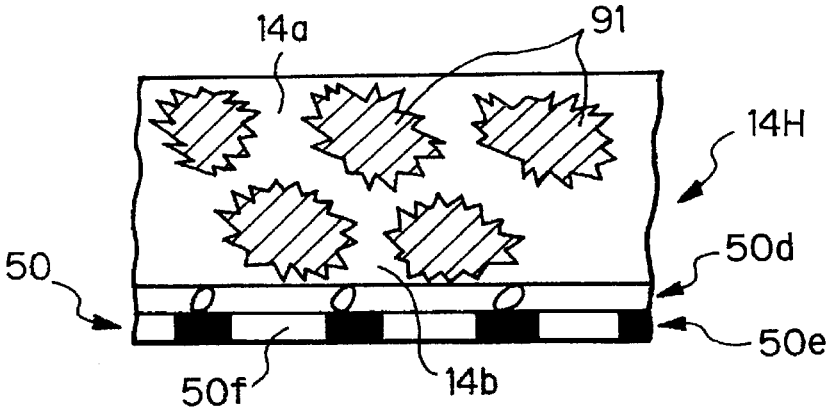
Figure 13C:
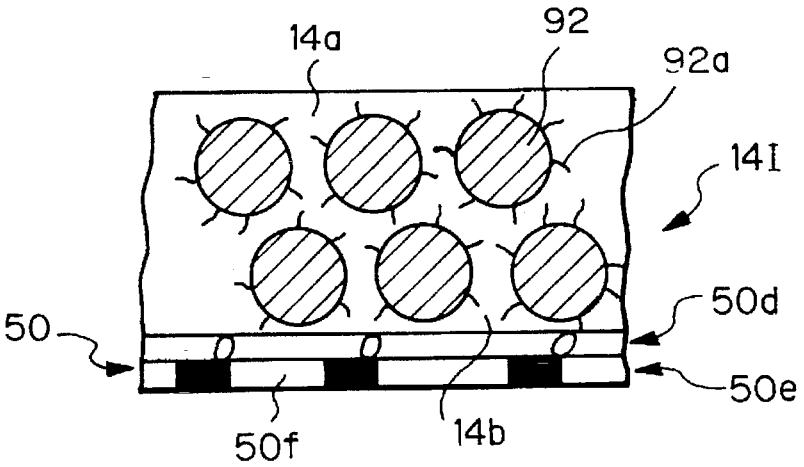

FIGS. 13A–13C each shows another specific scheme for increasing the contact area between the porous sheet and ink. In FIG. 13A, a sheet 14G has fibrous members **14*c* in the form of bundles 90. In FIG. 13B, a sheet 14H has natural fibers or similar fibers 91 having undulations on the surfaces thereof. In FIG. 13C, a sheet 14I has fibers 92 in which fine fibers 92*a* are implanted. By so increasing the contact area, it is possible to make the force F1 acting between each of the sheets 14G–14I and the ink 80 greater than the force F2 acting between the paper P and the ink 80. As a result, the amount of the ink 80 to be drawn out from the sheets 14G–14I is reduced. The sheets 14G–14I may each be included in the drum 11 in place of one of the previously stated sheets 14 and 14A–14F**.

In FIGS. 13A–13C, the stencil 50 made up of the thermoplastic resin film **50*e* and porous substrate 50*d* is shown as being wrapped around the porous sheets 14G–14I. Alternatively, the master 50A, FIG. 6, implemented only by the thermoplastic resin film 50*e* may be combined with any one of the sheets 14G–14I**.

Figure 14:
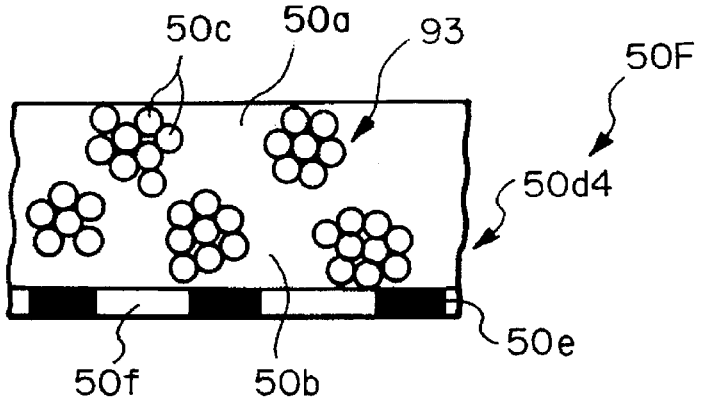
FIG. 14 is a fragmentary section showing a further specific configuration of the stencil.

Any one of the structures of the sheets 14 and 14G–14I for making the force F1 greater than the force 2 as described above may be applied to the stencil. For example, as shown in FIG. 14, use may be made of a stencil 50F having a thermoplastic resin film **50*e* and a porous substrate 50*d*4. The substrate 50*d*4 has bundles 93 of fibrous members 50*c***.

The stencil 50F may be used in combination with the conventional drum lacking the porous sheet 14.

In the stencils 50B–50D shown in FIGS. 7A–7C, the fibrous members **50*c* may be replaced with the fiber bundles 93 of FIG. 14, the fibers 91 of FIB. 13B having undulations, or the fibers 92 of FIG. 13C having the fine fibers 92*a* implanted therein. This makes the adhesion of the porous substrates 50*d*1–50*d*3 and ink 80 greater than the adhesion of the paper P and ink 80 by increasing the contact area between the substrates 50*d*1–50*d*3 and the ink 80. As a result, the amount of the ink 80 to be drawn out from the substrates 50*d*1–50*d*3** is further reduced.

Likewise, in the porous sheets 14, 14A, 14B and 14F, the fibrous members **14*c* may be replaced with the fiber bundles 90 of FIG. 13A, the fibers 91 of FIG. 13B, or the fibers 92 of FIG. 13C. This also makes the adhesive F1 between the sheets 14, 14A, 14B and 14F and the ink 80 greater than the adhesive F2 between the paper P and the ink 80 and thereby further reduces the amount of the ink 80 to be drawn out from the sheets 14, 14A, 14B and 14F**.

The drum 11 has been shown and described as having the porous support layer 12 and porous sheet 14. Alternatively, the drum 11 may implemented only by the hollow cylindrical porous sheet 14, as taught in, for example, Japanese Patent Laid-Open Publication No. 1-204781 or 59-218889.

Figure 15:
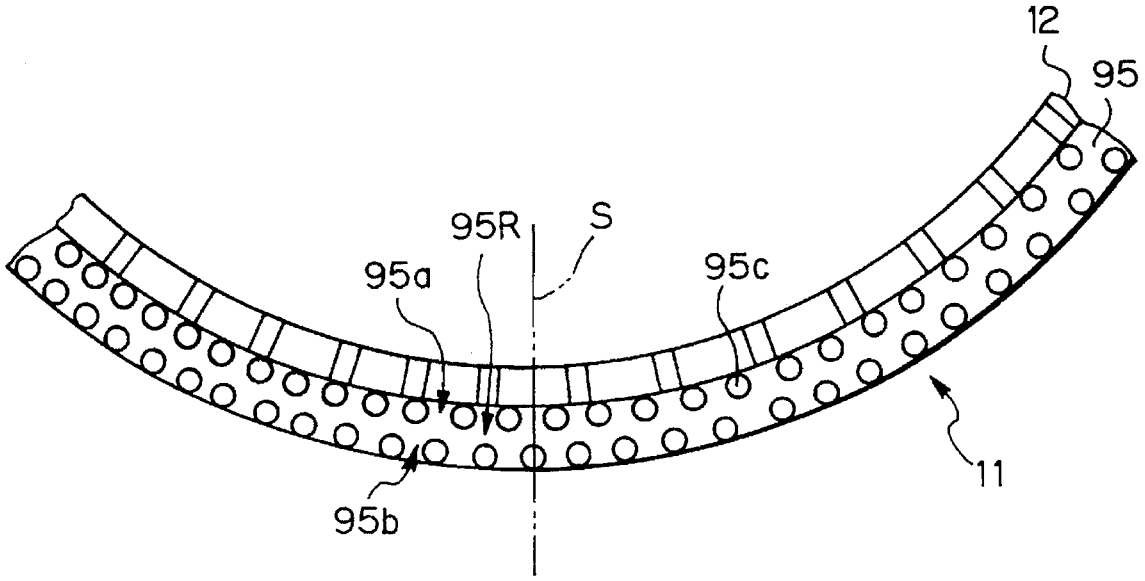
FIG. 15 is a fragmentary section showing yet another specific configuration of the porous sheet.

FIG. 15 shows a further specific configuration of the drum 11. As shown, the drum 11 has only the porous support layer 12. A screen or porous sheet 95, separate from the drum 11, is wrapped around the drum 11 and is formed with ink passages 95R. The passages 95R, defined by fibrous members **95*c*, are each configured such that the ink entered an inlet pore 95*a* is diverted from a single perpendicular S to the drum 11 at least once and then flows out via an outlet pore 95*b*. Regarding the screen 95, the structure shown in FIG. 15 may be replaced with any one of the structures of the porous sheets 14A–14I shown in FIGS. 4A–4E, 5 and 13A–13C**.

Figure 16:
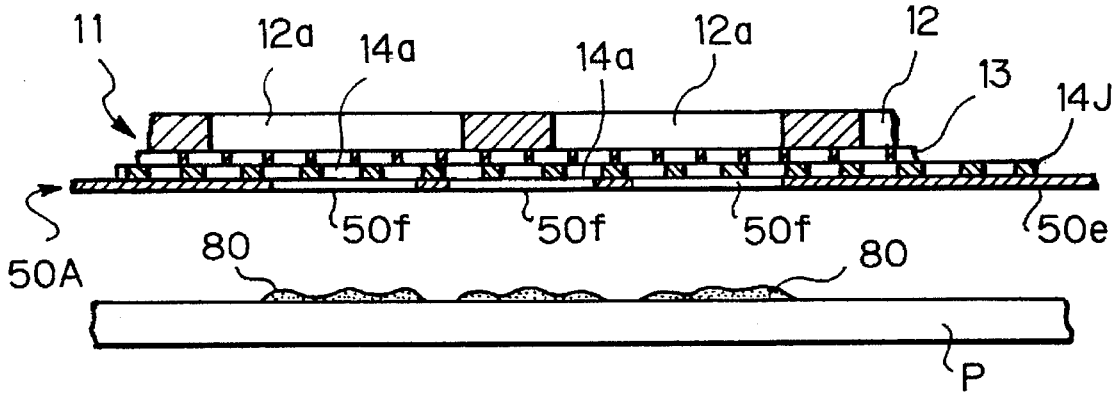
FIGS. 16 and 17 each shows an alternative embodiment of the present invention.
Figure 17:
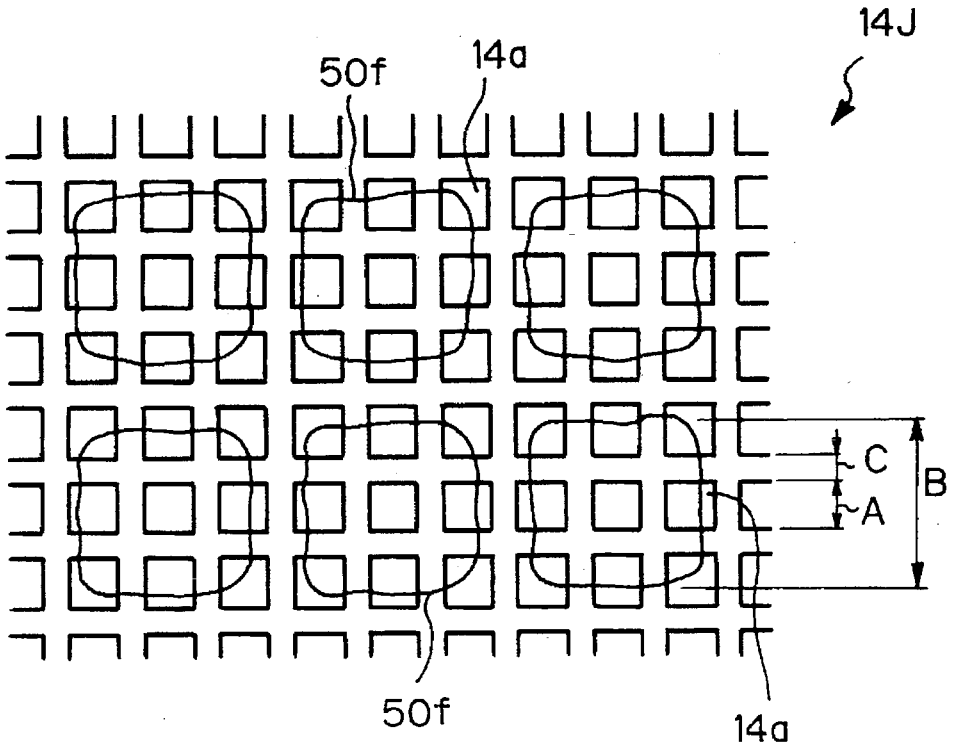

FIGS. 17 and 17 show an alternative embodiment of the present invention. As shown in FIG. 16, a master 50A is implemented only by a thermoplastic resin film **50*e* and formed with perforations 50*f*. As shown in FIGS. 1 and 16, the drum is made up of three layers, i.e., the cylindrical porous support layer 12, the ink retaining layer 13 surrounding the layer 12, and a mesh screen 14J surrounding the layer 13 and forming the outer periphery of the drum 11. The layer 12 is made of stainless steel or similar metal and formed with a number of pores 12*a* for passing the ink 80 therethrough. The layer 13 is implemented by a metallic mesh screen or foam resin in order to retain the ink 80 while passing it therethrough. A plurality of layers 13** may by provided, if desired.

As shown in FIG. 17, the mesh screen 14J is formed with square openings **14*a* for passing the ink 80 therethrough. The openings 14*a* are each sized 15 μm square which is smaller than the size B (about 40 μM) of a single substantially square perforation 50*f* formed in the stencil 50. The screen 14J has a line width C of 5 μm. The screen 14J is implemented by a thin sheet of, for example, copper or stainless steel and formed with the openings 14*a* by etching. The screen 14J has a uniform thickness and has at least one side thereof smoothed. The screen 14J is wrapped around the support layer 12 with the smoothed surface thereof facing outward. The screen 14J may be produced by the electroforming of a thin sheet having a uniform thickness and formed with the openings 14*a*, at least one side thereof being smoothed. The screen should preferably be about several microns to 30 μm thick; it should be as thin as possible within a range which does not lower the strength to an excessive degree. The etching or electroforming reduces the production cost of the screen 14J. Of course, the shape of each opening 14*a*** is not limited to a square, but it may be a circle, hexagon, polygon or any other suitable shape.

The openings **14*a* of the screen 14J shown in FIG. 16 and 17 is assumed to be 15 μm long at each side A. However, when each side B of the perforation 50*f* is 40 μm long, the side A may range from 5 μm to 20 μm. Specifically, when the side A is 5 μm long, the ratio of the area of the opening 14*a* ($5\times5$ μm$^2$) to the area of the perforation 50*f*, i.e., $[(5\times5)/(40\times40)]\times100$ is 1.6%. On the other hand, when the side A is 20 μm long, the above ratio is 25%, i.e., $[(20\times20)/(40\times40)]\times100=25$. If the radio is smaller than 1.6%, the amount of the ink 80 to be transferred to the paper P is too small to provide a printing with sufficient density. If the ratio is equal to or smaller than 25%, the ink 80** is transferred to the paper P in a desired small amount and, therefore, more effectively prevented from being transferred to the rear of the next printing. Hence, the above ratio should preferably lie in a range of from 1.6% to 25%.

As stated above, in the embodiment shown in FIGS. 16 and 17, the openings **14*a* of the mesh screen 14J are each sized greater than the perforations 50*f* of the master or stencil 50A. Hence, the ink to ooze out from the perforations 50*f* is reduced in amount. It follows that the ink transferred to the paper P infiltrates and dries rapidly and is, therefore, scarcely transferred to the rear of the overlying sheet. The master 50A, implemented only by the thermoplastic resin film 50*e*, reduces the amount of the ink 80 to be discarded therewith and obviates fiber marks. In addition, the master 50A is wrapped around the mesh screen 14J which is smoothed on the side contacting the stencil 50A and provided with a uniform thickness. This allows the mesh screen 14J and master 50A to contact each other over a broad area, reduces the wear of the master 50A due to the paper P, and protects the master 50A** from tearing.

In summary, it will be seen that the present invention provides a drum and a stencil having unprecedented advantages as enumerated below.

(1) Ink to be drawn out from a porous sheet is reduced. The ink, therefore, infiltrates into a paper and dries in a short time and is not transferred to the rear of the next paper or printing.

(2) When the stencil is implemented only by a thermosensitive resin film, the amount of ink to be deposited on the stencil and discarded together with the stencil is reduced. In addition, printed images are free from fiber marks attributable to the fibers of a porous substrate which would obstruct the ink transfer.

(3) The life of the stencil is extended because wear due to a paper is reduced.

Various modifications will become possible for those skilled in the art after receiving the teachings of the present disclosure without departing from the scope thereof.

What is claimed is:

1. A porous sheet which forms an outer periphery of a drum of a stencil printer, for supplying ink from an inner periphery of said drum to a paper via said porous sheet and a perforated stencil which is wrapped around said drum, said porous sheet comprising:

a main body;

inlet pores formed in said main body for receiving the ink from the inner periphery of the drum;

outlet pores formed in said main body for discharging the ink; and passages formed in said main body, each of said passages causing the ink which enters any one of said inlet pores to be diverted from a single perpendicular line to the drum at least once, and then flow out via at least one of said outlet pores, wherein said outlet pores provide for an adhesion to the ink so as to reduce an amount of ink drawn to the paper when the paper is separated from the perforated stencil.

2. A porous sheet as claimed in claim 1, wherein a surface of said main body contacting the perforated stencil is smoothed.

3. A porous sheet as claimed in claim 1, wherein said main body comprises fibrous members.

4. A porous sheet as claimed in claim 3, wherein said fibrous members each has an outside diameter, as measured in a direction parallel to said perpendicular line, which is smaller than a diameter of a perforation formed in the perforated stencil.

5. A porous sheet as claimed in claim 3, wherein said fibrous members have a maximum outside diameter and a pitch smaller than a diameter of a perforation formed in the perforated stencil.

6. A porous sheet as claimed in claim 1, wherein an area over which said main body and the ink contact is broad enough for adhesion acting between said main body and the ink to be greater than adhesion acting between the paper and the ink.

7. A porous sheet as claimed in claim 1, wherein said inlet pores and said outlet pores have a smaller size than perforations formed in the perforated stencil.

8. A perforated stencil and porous sheet arrangement for supplying ink fed from an inner periphery of a drum of a stencil printer to a paper via perforations of said stencil by being wrapped around said drum, said arrangement comprising:

a porous substrate formed with inlet pores and outlet pores for passing the ink therethrough;

a thermoplastic resin film to be perforated; and passages formed in said porous substrate, each of said passages causing the ink which enters any one of said inlet pores to be diverted from a single perpendicular line to the substrate at least once, and then flow out via at least one of said outlet pores, wherein an area over which said porous substrate and the ink contact is broad enough for adhesion acting between said porous substrate and the ink to be greater than adhesion acting between the paper and the ink, so as to reduce an amount of ink drawn to the paper when the paper is separated from the stencil.

9. An arrangement as claimed in claim 8, wherein said porous substrate comprises fibrous members.

10. An arrangement as claimed in claim 9, wherein said fibrous members each has an outside diameter, as measured in a direction parallel to said perpendicular line, smaller than a diameter of the perforation of said perforated stencil.

11. An arrangement as claimed in claim 9, wherein said fibrous members have a maximum outside diameter and a pitch smaller than a diameter of the perforation of said perforated stencil.

12. A stencil printer assembly for printing an image on a paper by supplying ink to said paper via a stencil formed with perforations, the assembly comprising:

a stencil making unit for perforating said stencil by heat for thereby producing said stencil;

a drum having an outer periphery formed by a porous sheet and for wrapping said stencil therearound;

an ink supply unit for supplying the ink from an inner periphery of said drum to said stencil; and a pressing member for pressing the paper against said stencil;

wherein said porous sheet comprises:

a main body;

inlet pores formed in said main body for receiving the ink from the inner periphery of the drum;

outlet pores formed in said main body for discharging the ink; and passages formed in said main body each of the passages causing the ink which enters any one of said inlet pores to be diverted from a single perpendicular line to the drum at least once, and then flow out via at least one of said outlet pores, wherein said outlet pores provide for an adhesion to the ink so as to reduce an amount of ink to the paper when the paper is separated from the stencil.

13. A stencil printer for printing an image on a paper by supplying ink to said paper via a stencil formed with perforations, comprising:

a stencil making unit for perforating said stencil by heat for thereby producing said stencil;

a drum for wrapping said stencil therearound;

an ink supply unit for supplying the ink from an inner periphery of said drum to said stencil; and a pressing member for pressing the paper against said stencil;

said stencil comprises:

a porous substrate formed with inlet pores and outlet pores for passing the ink therethrough;

a thermoplastic resin film to be perforated; and passages formed in said porous substrate, each of said passages causing the ink which enters any one of said inlet pores to be diverted from a single perpendicular line to the substrate at least once, and then flow out via at least one of said outlet pores, wherein said outlet pores provide for an adhesion to the ink so as to reduce an amount of ink drawn to the paper when the paper is separated from said stencil.

14. A stencil printer according to claim 13, wherein an area over which said sheet and the ink contact is broad enough for adhesion acting between said sheet and the ink to be greater than adhesion acting between the paper and the ink.

15. A stencil printer according to claim 13, further comprising a mesh screen formed around an outer periphery of the drum for supplying ink from the inner periphery of said drum to the paper via said mesh screen, said mesh screen being formed with openings having a smaller size than said perforations of said stencil.

16. A stencil printer as claimed in claim 15, wherein said mesh screen is smoothed on a side contacting the stencil and provided with a uniform thickness.

17. A perforated stencil and porous sheet arrangement for supplying ink fed from an inner periphery of a drum of a stencil printer to a paper via perforations of said stencil by being wrapped around said drum, said arrangement comprising:

a porous substrate formed with inlet pores and outlet pores for passing the ink therethrough;

a thermoplastic resin film to be perforated; and passages formed in said porous substrate, each of said passages causing the ink which enters any one of said inlet pores to be diverted from a single perpendicular line to the substrate at least once, and then flow out via at least one of said outlet pores, wherein said outlet pores provide for an adhesion to the ink so as to reduce an amount of ink to the paper when the paper is separated from said stencil.

18. A perforated stencil for supplying ink fed from an inner periphery of a drum of a stencil printer to a paper via perforations of said stencil by being wrapped around said drum, said stencil comprising:

a porous substrate formed with inlet pores and outlet pores for passing the ink therethrough;

a thermoplastic resin film to be perforated; and passages formed in said porous substrate, each of said passages causing the ink which enters any one of said inlet pores to be diverted from a single perpendicular line to the substrate at least once, and then flow out via at least one of said outlet pores, wherein said outlet pores provide for an adhesion to the ink so as to reduce an amount of ink to the paper when the paper is separated from said stencil.

19. A perforated stencil as claimed in claim 18, wherein said porous substrate comprises fibrous members.

20. A perforated stencil as claimed in claim 19, wherein said fibrous members each has an outside diameter, as measured in a direction parallel to said perpendicular line, smaller than a diameter of the perforation of said perforated stencil.

21. A perforated stencil as claimed in claim 19, wherein said fibrous members have a maximum outside diameter and a pitch smaller than a diameter of the perforation of said perforated stencil.

22. A perforated stencil as claimed in claim 18, wherein an area over which said porous substrate and the ink contact is broad enough for adhesion acting between said porous substrate and the ink to be greater than adhesion acting between the paper and the ink.

23. A stencil printer for printing an image on a paper by supplying ink to said paper via a stencil formed with perforations, comprising:

a stencil making unit for perforating said stencil by heat for thereby producing said stencil;

a drum for wrapping said stencil therearound;

a ink supply unit for supplying the ink from an inner periphery of said drum to said stencil; and a pressing member for pressing the paper against said stencil;

said drum comprising a mesh screen formed around an outer periphery of said drum for supplying ink from the inner periphery of said drum to the paper via said mesh screen, said mesh screen being formed with openings having a smaller size than said perforations of said stencil.

24. A stencil printer as claimed in claim 23, wherein said mesh screen is smoothed on a side contacting said stencil and provided with a uniform thickness.

* * * * *

UNITED STATES PATENT AND TRADEMARK OFFICE

CERTIFICATE OF CORRECTION

PATENT NO. : 5,662,040

DATED : September 2, 1997

INVENTOR(S) : Tomiya MORI, ET AL.

It is certified that error appears in the above-identified patent and that said Letters Patent is hereby corrected as shown below:

Column 1, line 35, change "are forms" to --each forms--;

line 40, change "polyester of" to --polyester or--.

Column 5, line 9, after "peripheral" delete "in".

Column 6, line 4, change "roller 15" to --roller 16--.

Column 7, line 49, change "15b" to --14b--.

Column 8, line 58, change "configures" to --configured--;

Column 8, line 59, change "derived" to --diverted--.

Column 11, line 5, change "FIB" to --FIG--;

line 39, change "Figs. 17 and 17" to --Figs. 16 and 17--;

line 56, change "about 40 $\mu$M" to --about 40 $\mu$m--.

UNITED STATES PATENT AND TRADEMARK OFFICE

CERTIFICATE OF CORRECTION

PATENT NO. : 5,662,040
DATED : September 2, 1997
INVENTOR(S) : Mori et al

It is certified that error appears in the above-indentified patent and that said Letters Patent is hereby corrected as shown below:

Column 5, line 9, after "difference" change "is" to --in--.

Signed and Sealed this

Seventh Day of July, 1998

Bruce Lehman

*Attest:*

BRUCE LEHMAN

*Attesting Officer*

*Commissioner of Patents and Trademarks*